United States Patent [19]

Roeker et al.

[11] Patent Number: 4,907,313

[45] Date of Patent: Mar. 13, 1990

[54] SELF CENTERING BUFFING PAD WITH LOW TEMPERATURE TUFT BONDING ADHESIVE

[75] Inventors: David C. Roeker; Ronald L. Ott, both of St. Paul, Minn.

[73] Assignee: Minnesota Mining and Manufacturing Company, Saint Paul, Minn.

[21] Appl. No.: 277,511

[22] Filed: Nov. 29, 1988

Related U.S. Application Data

[63] Continuation of Ser. No. 180,726, Apr. 6, 1988, abandoned, which is a continuation of Ser. No. 894,577, Aug. 8, 1986, abandoned.

[51] Int. Cl.[4] ..... B24D 13/14

[52] U.S. Cl. ..... 15/98; 15/230; 15/230.17; 15/230.18

[58] Field of Search ..... 15/230, 230.12, 230.14, 15/230.17, 230.18, 230.19, 97 R, 180, 98; 51/358, 376; 300/21

[56] References Cited

U.S. PATENT DOCUMENTS

| | | | |
|---|---|---|---|
| 3,007,289 | 11/1961 | Kent et al. | 15/230.18 |
| 3,345,735 | 10/1967 | Riker | 51/362 |
| 3,346,904 | 10/1967 | Armstrong | 15/230.17 |
| 3,430,283 | 3/1969 | Engel et al. | 15/230.12 |
| 3,537,122 | 11/1970 | Proffitt, Jr. | 15/230.12 |
| 4,045,836 | 9/1977 | Glenn | 15/230.17 |
| 4,149,294 | 4/1979 | MacKay, Jr. et al. | 15/230.12 |
| 4,692,958 | 9/1987 | McMakin | 15/230.12 |

*Primary Examiner*—Edward L. Roberts

*Attorney, Agent, or Firm*—Donald M. Sell; Walter N. Kirn; William L. Huebsch

[57] ABSTRACT

A buff adapted for self centering engagement with a backup pad comprising a circular body with a first fastener portion on its face surface. The buff includes a stiff flexible backing having a generally planar circular central portion and an annular flange only slightly larger than the diameter of the backup pad projecting from one side surface of its central portion, a second fastener portion fixed on the side surface of its central portion and adapted for engagement with the fastener portion on the backup pad, and a multiplicity of projecting tufts having central portions adhered in the backing by a thermoplastic adhesive that melts and adheres at a temperature under 100° C.

4 Claims, 2 Drawing Sheets

SELF CENTERING BUFFING PAD WITH LOW TEMPERATURE TUFT BONDING ADHESIVE

This is a continuation of application Ser. No. 180,726 filed Apr. 6, 1988, which was a continuation of application Ser. No. 894,577 filed Aug. 8, 1986, both now abandoned.

TECHNICAL FIELD

The present invention is related to circular buffing pads or buffs adapted to be releasably engaged with backup pads.

BACKGROUND OF THE INVENTION

Buffs are known which are adapted for engagement with a backup pad comprising a circular body adapted to be rotated about its axis by a drive motor, having a generally planar circular coaxial face surface, and a fastener portion at its face surface. Typically, such buffs comprise a flexible circular backing, and a multiplicity of U-shaped tufts having central portions engaged in the backing and projecting from one side of the backing; and a fastener portion adapted for engagement with the fastener portion on the back up is provided to hold the buff in place.

In many prior art buffs and backup pads of this type, the fastener portion on the backup pad is a threaded central post, and the fastener portion that attaches the buff is a nut including an internally threaded collar that can be inserted through a central hole in the buff and engaged with the post, and a flange that engages the buff around its central hole to hold the buff in place on the backup pad.

DISCLOSURE OF INVENTION

The present invention provides a backup pad and buff combination which incorporates hook and loop type attachment means and provides a buff that is both self centering on the backup pad and provides secure anchoring for tufts on the buff, together with a simple method for making the new buff.

According to the present invention, there is provided a buff adapted for self centering engagement with a backup pad comprising a circular body of a predetermined diameter adapted to be rotated about its axis by a drive motor, having a generally planar circular coaxial face surface, and a fastener portion on its face surface. The buff comprises a stiff flexible backing having a generally planar circular central portion and an annular flange integral and coaxial with its central portion projecting from one side surface of its central portion, which flange has an inner diameter only slightly larger than the diameter of the backup pad. A second fastener portion is attached on the side surface of the central portion from which the flange projects and is adapted for engagement with the fastener portion on the backup pad, and the buff includes a multiplicity of U-shaped tufts having central portions engaged in the backing and distal end portions projecting from the side of the backing opposite the fastener portion along the central portion and flange of the backing.

Also, preferably, in the buffing pad according to the present invention, the fastener portion on the buff is a nylon loop fabric and the backing comprises a thermoplastic adhesive having a softening and bonding temperature of less than 100 degrees Centigrade (212° F.) securely bonding the central portions of the tufts in the backing. Such adhesive provides the advantages of securely bonding to the central portions of the tufts when heated in a temperature range that will not cause the loops on the nylon loop fabric to melt, soften and/or compact, which will occur at around 155° to 160° C. (310° to 320° F.), and is not affected by aliphatic hydrocarbons (e.g., kerosene or mineral spirits) typically found in abrasive rubbing compound which are used with the buff to smooth and finish surfaces, typically of automotive paint. If thermoplastic adhesives that melt at temperatures between 100° and 155° C. are used adjacent the tufts, they will apparently cause water absorbed in the tufts to vaporize and will not bond to the tufts within the short time period (i.e., under three minutes) that the adhesive is normally melted or softened during a heating cycle used to make the buff.

BRIEF DESCRIPTION OF THE DRAWING

The present invention will be further described with reference to the accompanying drawing wherein like numbers refer to like parts in the several views, and wherein.

DETAILED DESCRIPTION

Figure 1:
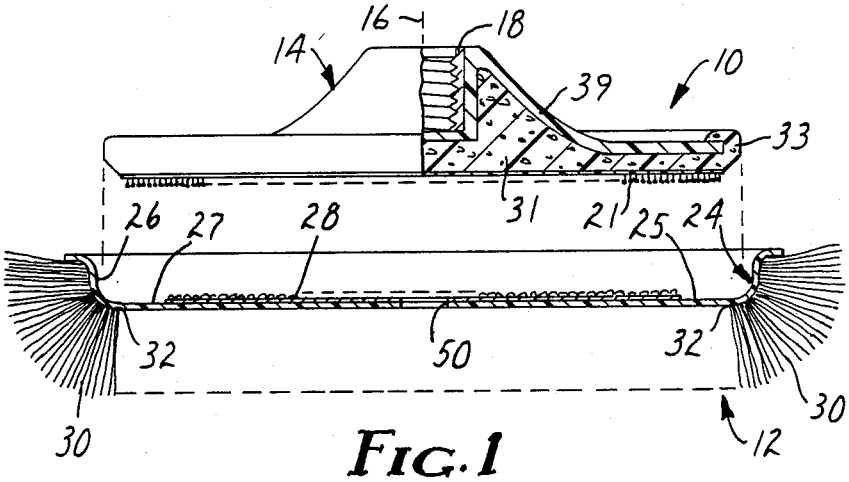
FIG. 1 is a side view, partially in Section, of a backup pad and buff according to the present invention shown separated from each other.

Referring now to FIG. 1 there is shown the combination according to the present invention of a backup pad 10 and a buff 12.

Generally, the backup pad 10 comprises a circular body 14 of a predetermined diameter adapted to be rotated about its axis 16 by a drive motor (not shown) through engagement with an internally threaded drive nut 18 included in the body 14, and has a generally planar circular coaxial face surface on which is fixed a first fastener portion 21 comprising a multiplicity of projecting flexible polymeric headed stems. The buff 12 comprises a stiff flexible backing 24 having a generally planar circular central portion 25 and an annular generally cylindrical flange 26 integral and coaxial with the central portion 25 projecting from one side surface 27 of the central portion 25, which flange 26 has an inner diameter only slightly larger than the diameter of the backup pad 10. The buff 12 also comprises a second fastener portion 28 on the side surface 27 of the central portion 25 adapted for engagement with the first fastener portion 21 on the backup pad 10, and a multiplicity of U-shaped tufts 30 having central portions 32 engaged in the backing 24 and distal end portions projecting from the surface of the backing 24 opposite the side surface 27 along both the central portion 25 and the flange 26.

More specifically the backup pad 10 preferably comprises a layer 31 of tough, dense, stiff, resiliently compressible foam (e.g., closed cell polyester urethane foam available from Perry Chemical, Lafayette, Indiana) having a peripheral edge surface 33. A circular rigid polymeric (e.g. thermoplastic polyester) backing plate 39 is coaxially fixed to one surface of the layer 31 of foam with its peripheral edge protected within an annular ridge formed on the layer 31 of foam. The rigid backing plate 39 has a concentric generally frustro-conical projecting central portion including a concentric cylindrical central collar in which is fixed the externally knurled nut 18 (e.g., having a ⅝-11 inner thread), which nut 18 provides means adapted for coupling the backup pad 10 to a threaded drive shaft of a drive motor (not shown). The backup pad 10 also includes the flexible first fastener portion 21 fixed to the surface of the layer 31 of foam opposite the backing plate 39 and comprising the multiplicity of projecting resiliently flexible polypropylene stems with generally semispherical heads on their distal ends (e.g., the fastener portion sold under the trade designation 1H2 by Kanebo Bell-Touch, Ltd., Amashin Building 13-8, Nishi-Temna 4-Chome, Kita-Ku, Osaka 530, Japan).

The generally cylindrical flange 26 of the buff 12 has sufficient axial height above the central portion 25 of its backing 24 that the edge surface 33 of the backup pad 10 is almost fully received within the flange 26 before the fastener portions 21 and 28 engage. This insures proper self centering of the buff 12 around the backup pad 10. Upon pressing together of the fastener portions 21 and 28 the loops of the second fastener portion 28 will engage around the heads on the stems of the first fastener portion 21 to retain the buff 12 on the backup pad 10 and afford transfer of rotational forces from the backup pad 10 to the buff 12 to rotate the tufts 30 against a surface, such as that of an automobile, to be polished, etc.

Figure 2:
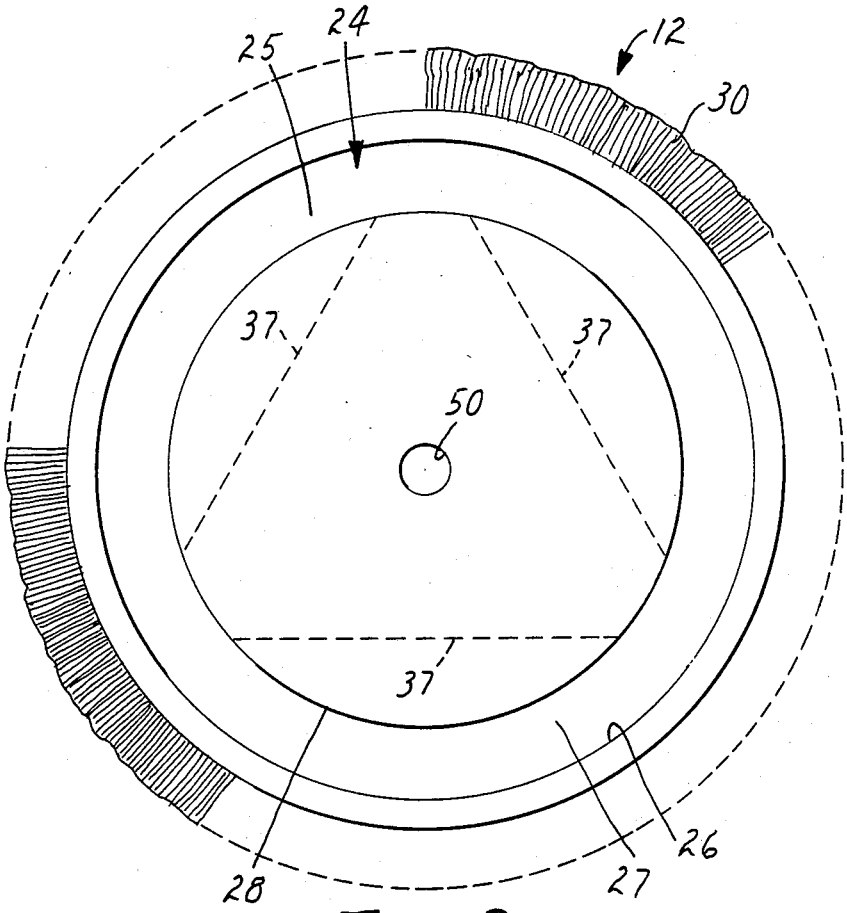
FIG. 2 is a back plan view of the buff of FIG. 1.

When it is desired to remove the buff 12 from the backup pad 10 it can be grasped at one portion of its flange 26 and pulled away from the face surface 20 of the backup pad 10 which causes the fastener portions 21 and 28 to peel apart so that the buff 12 can be separated from the backup pad 10. As shown is FIG. 2, the second fastener portion 28 may be circular of a diameter slightly smaller than the diameter of the central portion 25 to facilitate initiation of such peeling or, optionally may have arcuate side portions removed as along the dotted lines 37 which affords even further separation between the buff 12 and pad 10 at spaced locations around the periphery of the buff 12 to initiate such peeling.

Figure 3:
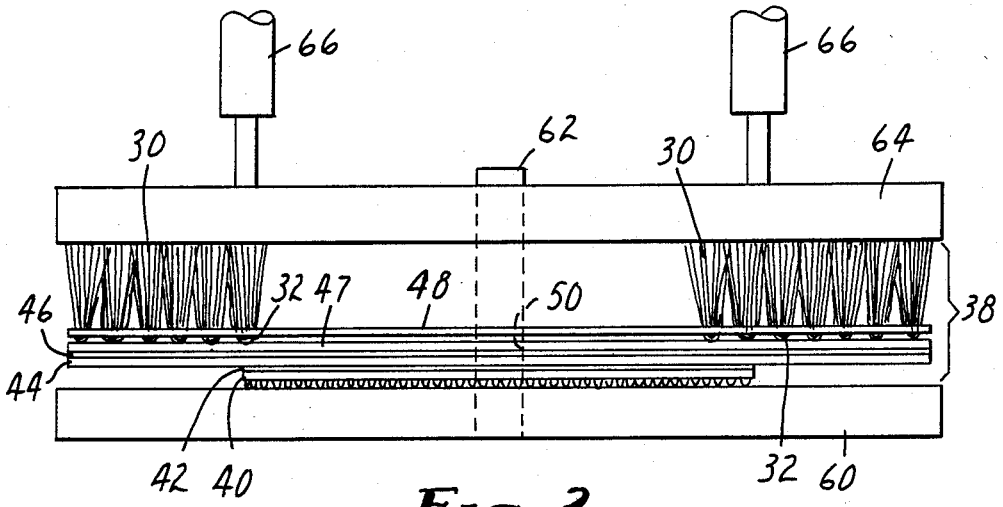
FIGS. 3 and 4 are side views schematically illustrating sequential steps in a method according to the present invention for making the buff shown in FIGS. 1 and 2, with FIG. 4 being a sectional view.
Figure 4:
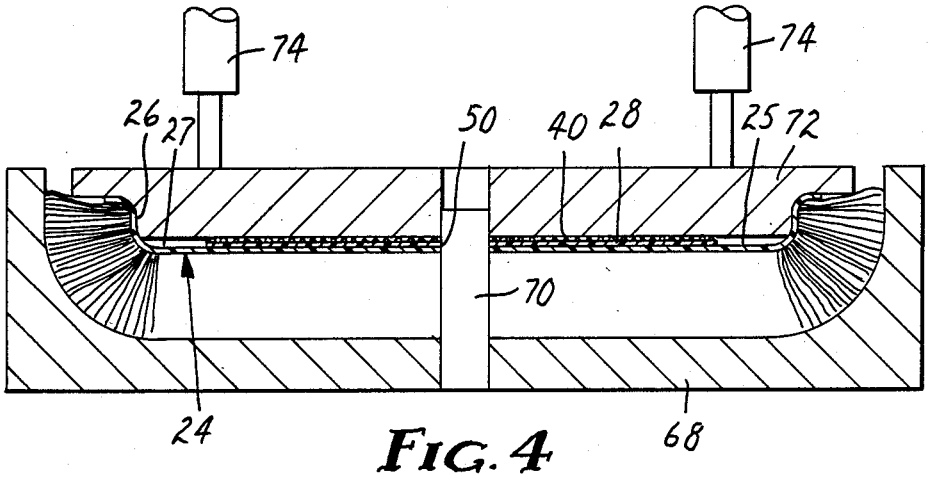

Referring now to FIGS. 3 and 4 there is schematically illustrated a method according to the present invention for making the buff 12.

The method for forming the buff 12 comprises the step illustrated in FIG. 3 of providing a laminate 38 comprising a loop-fabric layer 40 having a multiplicity of loops projecting from one surface, a first layer 42 of thermoplastic adhesive which softens and adheres at a temperature below about 155° C. on the side of the loop-fabric layer 40 opposite the loops, a layer 44 of polymeric material that will soften and become conformable and will be adhered to by the softened first layer 42 of adhesive at a temperature below about 155° C., a second layer 46 of thermoplastic adhesive which softens and adheres to the layer 44 of polymeric material at a temperature below about 155° C. on the side of the layer 44 of polymeric material opposite the first layer 42 of adhesive, a third layer 47 of thermoplastic adhesive which softens and adheres to both the second layer 46 of adhesive and the tufts 30 at a temperature below about 100° C. on the side of the second layer 46 of adhesive opposite the layer 44 of polymeric material, and a base-fabric layer 48 having central portions 32 of the U-shaped tufts 30 engaged through it and disposed with the side of the base-fabric layer 48 along which the central portions 32 of the tufts 30 are disposed (and those central portions 32) against the third layer 47 of adhesive so that the distal end portions of the tufts 30 project from the side of the base-fabric layer 48 opposite the second layer 46 of adhesive. As is shown in FIG. 3 the loop-fabric layer 40 in the laminate 38 is pressed against a planar face of a platen 60 heated to a temperature under about 155° C. for a time that will cause a temperature gradient through the laminate 38 to soften the first and second layers 42 and 46 of adhesive and the layer 44 of polymeric material and adhere the softened adhesive in those layers 42 and 46 to the layer 44 of polymeric material and the loop-fabric layer 40; and will soften the third layer of adhesive 47 at a slightly lower temperature and adhere it both to the second layer 46 of adhesive and to the central portions 32 of the tufts 30. While it may well be possible to eliminate the second layer 46 of adhesive and cause the third layer 47 of adhesive to adhere directly to the layer 44 of polymeric material, better results have been obtained with the adhesives described below where both the second and third layers 46 and 47 are used.

As is shown in FIG. 4, the heated laminate is then formed to provide the backing 24 having the generally planar circular central portion 25 and the annular flange 26 integral and coaxial with the central portion 25 projecting from the side surface 27 of the central portion 25, on which the loop-fabric layer 40 which provides the second fastener portion 28 is positioned with the tufts 30 projecting from the opposite side of the backing 24, after which the formed buff 10 is allowed to cool.

Preferably, as illustrated in FIG. 3, each of the layers 40, 42, 44, 46, 47 and 48 in the laminate 38 have a central circular opening 50 and are positioned around a guide post 62 on the platen 60 to facilitate proper concentric alignment thereof as the laminate 38 is pressed against the platen 60, which pressing can be done by a plate 64 having a central opening in which the guide post 62 is slideably received, and to which plate 64 pressure is applied by air or hydraulic cylinders 66. Similarly, as illustrated in FIG. 4, the forming step can be done between a non-heated platen 68 having a concave face with a central guide pin 70 that can be received as the aligned central openings 50 in the layers 40, 42, 44, 46, 47 and 48 of the heated 38 laminate to properly position it for forming by a mating convex platen 72 also slideably receiving the guide pin 70 and being moved by air or hydraulic cylinders 74.

As a preferred illustrative example, the loop-fabric layer 40 of the laminate 38 may be the nylon knit loop fabric sold under the trade designation Type SJ 3491 "Scotchmate" TM by Minnesota Mining and Manufacturing Company, St. Paul, Minnesota; the first and second layers of adhesive 42 and 46 may be 0.007 to 0.015 centimeter (0.003 to 0.006 inch) and 0.007 to 0.015 centimeter (0.003 to 0.006 inch) thick layers respectively of ethylene acrylic acid based adhesive film such as that commercially designated XO 66300.16 available from Dow Chemical Company, Midland, Mich. which softens and bonds at about 102° to 110° C. or 215° to 230° F.; the layer 44 of polymeric material may be high density polyethylene in the range of about 0.05 to 0.06 centimeter (0.020 to 0.025 inch); The third layer of adhesive 47 may be a 0.005 to 0.015 centimeter (0.002 to 0.006 inch) thick layer of ethylene acrylic acid based adhesive film such as that commercially designated XO 66300.21 available from Dow Chemical Company, Midland, Mich. which softens and bonds at about 82° C. (180° F.); and the base-fabric layer 48 may be a No. 2470 "Reemay" TM spun bond polyester commercially available from E. I. duPont, Willmington, Del. with which U-shaped tufts of wool, synthetic fabric, or blends thereof are engaged.

When such a laminate is heated through its loop-fabric layer 40 on the platen 60 heated to about 150° C. (300° F.) for 2 to 3 minutes, the adhesive the layers 42 and 46 will soften and adhere to the loop fabric layer 40 and the layer 44 of polymeric material whereas the adhesive in the third layer 47 will soften and adhesive to the adhesive in the second layer 46, the base fabric layer 48, and the central portions 32 of the tufts. The heated laminate could then be easily shaped between the non-heated platens 68 and 72 and allowed to cool between the platens 68 and 72 to form the buff 12.

The method and structure of the present invention have each now been described with reference to one embodiment thereof. It will be apparent to those skilled in the art that many changes can be made in the embodiments described without departing from the scope of the present invention. Thus, the scope of the present invention should not be limited to the method and structure described in this application, but only by methods and structures described by the language of the claims and the equivalents of those methods and structures.

What is claimed:

1. A buff adapted for self centering engagement with a backup pad comprising a circular body of a predetermined diameter adapted to be rotated about its axis by a drive motor, having a generally planar circular coaxial face surface, and a first fastener portion on said face surface, said buff comprising:

a stiff flexible backing having a generally planar circular central portion and an annular flange integral and coaxial with said central portion projecting from one side surface of said central portion, said flange having an inner diameter only slightly larger than the diameter of said backup pad, a second fastener portion on said one side surface of said central portion adapted for engagement with the fastener portion on a said backup pad; and a multiplicity of tufts having central portions engaged in said backing and distal end portions projecting from the side of said backing opposite said one side along said central portion and said flange.

2. A buff according to claim 1 wherein said backing comprises a thermoplastic adhesive having a softening and bonding temperature of less than 100 degrees Centigrade securely bonding the central portions of said tufts in said backing.

3. In combination a backup pad comprising a circular body of a predetermined diameter adapted to be rotated about its axis by a drive motor and having a generally planar circular coaxial face surface, and a first fastener portion on said face surface; and a buff comprising:

a stiff flexible backing having a generally planar circular central portion and an annular flange integral and coaxial with said central portion projecting from one side surface of said central portion, said flange having an inner diameter only slightly larger than the diameter of said backup pad, a multiplicity of tufts having central portions engaged in said backing and distal end portions projecting from the side of said backing opposite said one side along said central portion and said flange; and a second fastener portion on said one side surface of said central portion adapted for engagement with the first fastener portion on said backup pad.

4. A combination according to claim 3 wherein said backing comprises a thermoplastic adhesive having a softening and bonding temperature of less than 100 degrees Centigrade securely bonding the central portions of said tufts in said backing.

* * * * *